US005121919A

United States Patent [19]

Martti

[11] Patent Number: 5,121,919

[45] Date of Patent: Jun. 16, 1992

[54] GAME PLAYING DEVICE

[75] Inventor: Lauri Martti, Helsinki, Finland

[73] Assignee: Raha-Automaarriyhdistys, Espoo, Finland

[21] Appl. No.: 623,806

[22] PCT Filed: Jun. 14, 1989

[86] PCT No.: PCT/FI89/00112

§ 371 Date: Dec. 24, 1990

§ 102(e) Date: Dec. 24, 1990

[87] PCT Pub. No.: WO89/12875

PCT Pub. Date: Dec. 28, 1989

[30] Foreign Application Priority Data

Jun. 23, 1988 [FI] Finland ..... 883041

[51] Int. Cl.[5] ..... G07F 17/32

[52] U.S. Cl. ..... 273/121 B; 273/118 A; 273/119 A; 273/121 A

[58] Field of Search ..... 273/118 R, 118 A, 119 R, 273/119 A, 119 B, 120 R, 120 A, 121 R, 121 A, 121 B

[56] References Cited

U.S. PATENT DOCUMENTS 3,797,828 3/1974 Ishikawa et al. ..... 273/121 B
3,825,265 7/1974 Pitkanen et al. ..... 273/121 B
4,487,414 12/1984 Karkkainen et al. ..... 273/371
4,508,336 4/1985 Yokoi ..... 273/121 B
4,840,375 6/1989 Lawlor et al. ..... 273/121 B

FOREIGN PATENT DOCUMENTS

88/03299 5/1988 PCT Int'l Appl. .
2066991 1/1980 United Kingdom .

*Primary Examiner*—William H. Grieb
*Assistant Examiner*—Raleigh W. Chiu
*Attorney, Agent, or Firm*—Nixon & Vanderhye

[57] ABSTRACT

A game playing device comprising a play panel (1); a launching device (8) for launching a coin or the like token (3) into the play panel; and a primary game playing apparatus (4) having an actuator (5) disposed in the play panel on the paths of movement of the tokens, the actuator detecting the passing of tokens therethrough for controlling a prize delivering machinery (7). In order to make the game more versatile and interesting, the game playing device is provided with an additional game playing apparatus in addition to the primary game playing apparatus and corresponding additional actuator (14) detecting the passing of the tokens therethrough and controlling the starting of the operation of the additional game playing apparatus.

14 Claims, 2 Drawing Sheets

GAME PLAYING DEVICE

Figure 1:
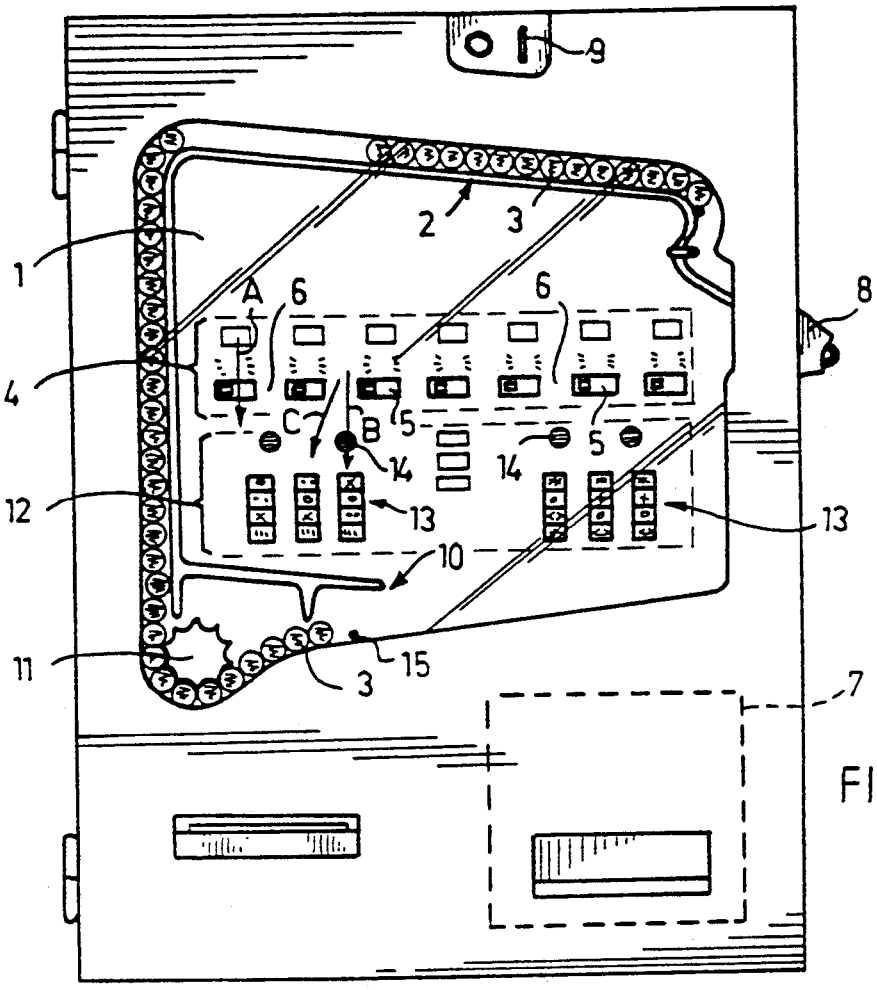

This invention relates to a game playing device comprising

- a vertical play panel defining an area of movement for coins and similar flat, rolling tokens;
- a primary game playing apparatus comprising actuating means disposed in the area of movement of the play panel and intended for detecting the passing of tokens therethrough, and a prize delivering machinery controlled by the actuating means;
- a launching device disposed at the side of the area of movement of the play panel for launching tokens into the area of movement;
- a token insert device for passing a token into the launching device;
- receiving means disposed in the area of movement of the play panel for receiving tokens passed through the actuating means; and
- at least one additional game playing apparatus in addition to the primary game playing apparatus.

There is a great variety of prior art game playing devices the operation of which is based on the movement of coins or the like, referred to as tokens below, in a vertical play panel and in which a token is dropped or launched into the play panel in an attempt to pass it through one of the actuating means disposed in the area of movement of the play panel. The actuating means are arranged to activate a prize delivering machinery for delivering an appropriate prize for the player. If the player fails to pass the token through one of the actuating means, and the token passes between or past them, the player does not win any prize but loses the stake by which he initiated the game.

Such game playing devices include conventional slot machines. Finnish Patent Specification 37 712 discloses a mechanically operated slot machine in which the player launches a coin which moves within the play panel, whereas Finnish Patent Specification 63 123 discloses an electronically operated slot machine which does not require a coin as a stake but coins moving within the play panel are used in the game. In these game playing devices, the actuating means of the game playing apparatus are grouped in the play panel with mutual spacing so that a coin launched into the play panel drops down into receiving means either through one of the actuating means or between two adjacent actuating means In game playing devices of this type, the game ends after the token has traversed the play area formed by the actuating means. In some game playing devices, it is possible to vary the amount to be won or give bonuses depending, e.g. on the number of the playing rounds and/or the passing of the token through one or more predetermined actuating means in order to inveigle the player to continue the game. In all game playing devices, the amount to be won as such as well as the possible extra prizes and bonuses are decided after the token has passed through the actuating means or past it.

The object of the present invention is to provide a game playing device which avoids the above-described drawback and which makes the playing more varied and more interesting. This object is achieved by means of a game playing device according to the invention, which is characterized in that the additional game playing apparatus operable by tokens is provided with additional actuating means disposed in the area of movement of the play panel, said additional actuating means detecting the passing of tokens therethrough in the area of movement and controlling the operation of the additional game playing apparatus.

The invention is based on the idea that after the token has traversed the play area formed by the actuating means of the primary game playing apparatus, that is, after it has performed its primary playing function, and has influenced the outcome of the game, that is, whether a prize is to be paid out or not, it is further used for starting the additional game playing apparatus under certain circumstances. In this way, it is possible to offer the player still another opportunity of winning a prize, e.g., to reward a good player or to give consolation to a poor player. As a consequence, the game playing device is more interesting, because at best a single token launched into the play panel may be able to participate in two games in succession. The additional game playing apparatus may be of quite another type than the primary game playing apparatus.

Figure 2:
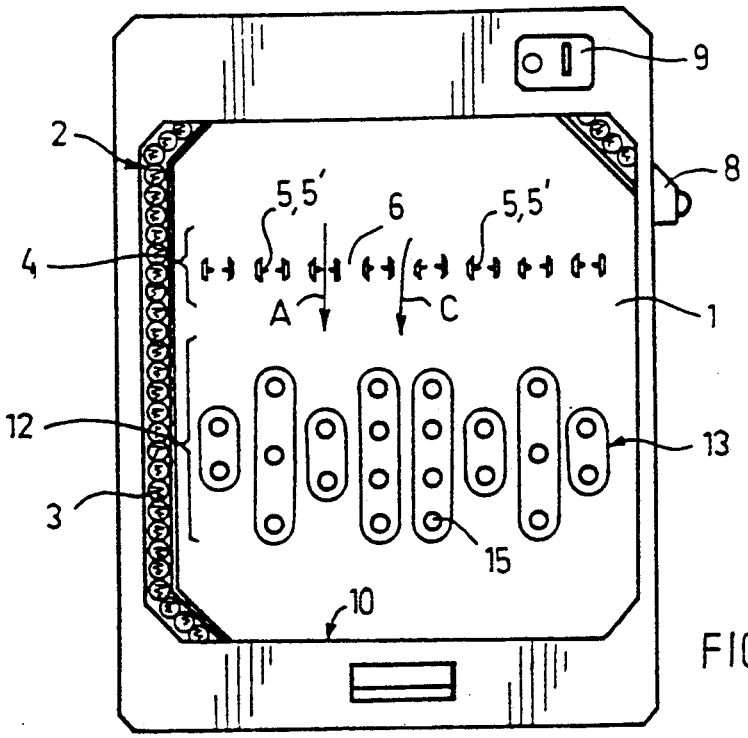
Figure 3:
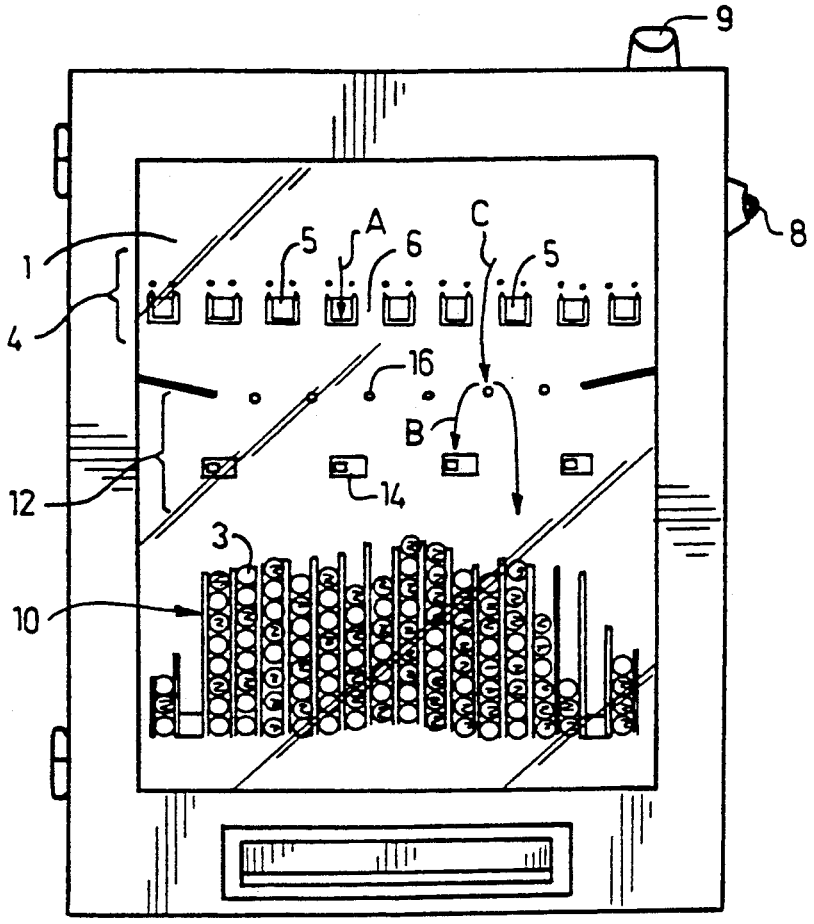

In the following, the invention will be described in greater detail with reference to the attached drawings, wherein FIG. 1 is a schematical front view of one embodiment of a game playing device according to the invention;

FIG. 2 is a schematical view of another embodiment of the game playing device according to the invention; and FIG. 3 is a schematical view of still another embodiment of the game playing device.

The word "tokens" as used in the present specification and claims encompasses, coins and all similar flat, rolling objects.

The game playing device shown in FIG. 1 of the drawings corresponds in structure and operation to the one disclosed in U.S. Pat. No. 4,487,414, the disclosure of which is hereby incorporated by reference herein.

The game playing device comprises a play panel 1 defining an area of movement 2 for tokens 3. A primary game playing apparatus 4, shown only schematically by broken lines, is disposed behind the play panel. The primary game playing apparatus comprises actuating means 5, in this case electric sensing means, disposed with mutual spacing in the area of movement and defining therebetween passages 6 for the tokens. The actuating means are arranged to influence an electronically controlled prize delivering machinery 7 disposed behind the play panel, so that the passing of a token through one of the actuating means affects the prize to be paid out to the player. The game playing device further comprises a launching device 8 for launching a token to move along a path, and a token insert 9 for a coin or the like token required for starting the game. The closed path of the tokens within the play panel goes through the launching device. Receiving means 10 for receiving the tokens are provided at the bottom of the play panel; further, a lifting device 11 is provided in the play panel for transporting the tokens.

According to the invention, the game playing device is provided with an additional game playing apparatus 12, similarly shown only schematically by broken lines. The additional game playing apparatus 12 comprises two displays 13 disposed within an area between the actuating means 5 of the primary game playing apparatus and the receiving means 10. In this particular case, the additional game playing apparatus is a so called fruit machine which pays out a prize with a certain combination of symbols. Additional actuating means 14 are mounted in the play panel above the displays, which actuating means detect the passing of a token therethrough and start the operation of the additional game playing apparatus. The additional actuating means are disposed below the passages 6 between the three outermost actuating means 5.

To start the game playing device, the player launches a token by the launching device into the area of movement of the play panel, trying to make it pass through one of the primary actuating means 5. If the token passes through one of the actuating means (path A), it applies a respective impulse to the prize delivering machinery. If the token drops down between two adjacent actuating means and further through the passage 6, its path may go either through the additional actuating means 14 of the additional game playing apparatus (path B) or past it (path C), depending on the angle of entrance of the token. In the former case, the additional actuating means apply an impulse which starts the operation of the additional game playing apparatus so that the drums visible in the displays start to rotate, and the possible winning line appears in the displays. The additional game playing apparatus thereby applies a respective impulse to the prize delivering machinery.

As appears from the above, the player can, with the present game playing device, play with a single token a conventional slot machine game in addition to which he may be able to play a round of the fruit game as a consolation if he does not manage to get the token through the actuating means 5 of the primary game playing apparatus, but the token nevertheless has passed through predetermined actuating means. If the token, however, moves down on either side of the middlemost actuating means giving the best prize, the token does not start the additional game, so that the player will not get any further opportunity of winning a prize.

The only major difference between the game playing device shown in FIG. 2 and that shown in FIG. 1 is that the starting of the additional game playing apparatus 12 is connected to the passing of a token through the actuating means of the primary game playing apparatus. Thereby the actuating means of the primary game playing apparatus also serve as additional actuating means 5' for the additional game, and apply an impulse to the additional game playing apparatus, too, when the token passes therethrough, for starting the additional game.

In this embodiment, the additional game is a kind of pattern game in which various patterns formed by lit lamps 15 give prizes of different values. When a token passes through one of the actuating means, one lamp in the sequence of lamps below the actuating means is lit. In this way the player can decide in advance into which actuating means he tries to get the token.

As is apparent from the above, this game playing device enables the player to play a conventional slot machine game or alternatively a pattern game with a single token, whereby he gets into the bargain an opportunity of winning an extra prize offered by the other game if he succeeds in getting the token through one of the actuating means (path A). If the token, instead, drops down between the actuating means (path C), the player will not get any further chance of winning an extra prize.

The game playing device shown in FIG. 3 corresponds in structure and operation to the one disclosed in Finnish Patent Specification 37 712. In this game playing device, a token launched at one of the actuating means 5 of the primary game playing apparatus (path A) drops through the opening formed by the actuating means behind the play panel and causes a respective impulse to be applied to the prize delivering machinery. On the other hand, a token dropping down between the actuating means (path C), descends within the play panel toward the receiving means. Pins 16 are fastened to the play panel below the outermost passages 6, and additional actuating means 14 for the additional game 12 are provided in the area of movement of the play panel adjacent to the pins. When a token drops between two adjacent primary actuating means 5, it strikes the pin and bounces on either side. The path of the token may thereby go through one of the additional actuating means (path B), which applies a respective impulse to the prize delivering machinery.

It is apparent that this game playing device, too, enables the player to play with a single token a conventional slot machine game in addition to which he is able to play a round of a bagatelle-type game if he does not succeed in passing the token through the actuating means of the primary game.

The drawings and the description related thereto are only intended to illustrate the idea of the invention. In their details, the game playing device according to the invention may vary within the scope of the claims. The sensing means 15 of the receiving means can be utilized as additional actuating means for the additional game playing apparatus as the sensing means record the passing of the token. Thereby the sensing means 15 can start the additional game playing apparatus when the token passes the sensing means if the actuating means of the primary game playing apparatus have not recorded the passing of the token therethrough.

I claim:

1. A game playing device comprising:

a vertical play panel defining an area of movement for tokens;

a primary game playing apparatus comprising actuating means disposed in the area of movement of the play panel and intended for detecting the passing of tokens therethrough, and a prize delivery machinery controlled by the actuating means;

a launching device disposed at the side of the area of movement of the play panel for launching tokens into the area of movement;

a token insert device for passing a token into the launching device;

receiving means disposed in the area of movement of the play panel for receiving tokens passed through the actuating means; and at least one additional game playing apparatus in addition to and different from the primary game playing apparatus, said additional game playing apparatus being operable by the same tokens as the primary game playing apparatus, and being provided with additional actuating means disposed in the area of movement of the play panel, said additional actuating means detecting the passing of the tokens therethrough in the area of movement and controlling the operation of said additional game playing apparatus in response to the detected tokens.

2. A game playing device according to claim 1 wherein said additional actuating means of the additional game playing apparatus are disposed within an area between the actuating means of the primary game playing apparatus and the receiving means.

3. A game playing device according to claim 2, wherein the actuating means of the primary playing apparatus are spaced from each other in the area of movement and defined therebetween passages for tokens. and wherein said additional actuating means of the additional game playing apparatus are positioned on a path along which the tokens move when they pass through at least one of the actuating means of the primary game playing apparatus.

4. A game playing device according to claim 3 wherein said additional game playing apparatus is a rotating drum device having symbols.

5. A game playing device according to claim 4 wherein said additional game playing apparatus is a rotating drum device having symbols.

6. A game playing device according to claim 2 wherein the actuating means of the primary game playing apparatus are spaced from each other in the area of movement and define therebetween passages for the tokens, and wherein said additional actuating means of the additional game playing apparatus are positioned on a path along which the tokens move when they pass through at least one of the passages of the primary game playing apparatus.

7. A game playing device according to claim 2 wherein a display means for the additional game playing apparatus are disposed within an area between the actuating means of the primary game playing apparatus and the receiving means.

8. A game playing device according to claim 1 wherein said additional actuating means of the additional game playing apparatus are formed by the actuating means of the primary game playing apparatus for controlling not only the prize delivering machinery of the primary game playing apparatus but also for the starting of the operation of the additional game playing apparatus.

9. A game playing device according to claim 1 wherein said actuating means is an electrical sensor.

10. A game playing device according to claim 1 wherein said additional game playing apparatus is a rotating drum device having symbols.

11. A game playing device according to claim 10 wherein the symbols on the rotating drums are fruit.

12. A game playing device according to claim 11 wherein said actuating means is an electrical sensor.

13. A game playing device according to claim 11 wherein said additional game playing apparatus is a pattern type game having illuminated lamps.

14. A game playing device according to claim 1 wherein said additional game playing apparatus is a pattern type game having illuminated lamps.

* * * * *